US009469042B2

(12) United States Patent
Götz et al.

(10) Patent No.: US 9,469,042 B2
(45) Date of Patent: Oct. 18, 2016

(54) METHOD AND APPARATUS FOR PROCESSING A MATERIAL WEB

(75) Inventors: Fritz Rainer Götz, Kirchheim U. Teck (DE); Andreas Baumüller, Nuremberg (DE)

(73) Assignee: Baumueller Nuernberg GmbH, Nuernberg (DE)

( * ) Notice: Subject to any disclaimer, the term of this patent is extended or adjusted under 35 U.S.C. 154(b) by 1031 days.

(21) Appl. No.: 13/572,891

(22) Filed: Aug. 13, 2012

(65) Prior Publication Data

US 2013/0036883 A1 Feb. 14, 2013

(30) Foreign Application Priority Data

Aug. 12, 2011 (DE) ..... 10 2011 110 038

(51) Int. Cl.

| | |
|---|---|
| ***B26D 7/32*** | (2006.01) |
| ***B26D 1/04*** | (2006.01) |
| ***B26D 1/09*** | (2006.01) |
| ***B65H 35/06*** | (2006.01) |
| ***B65H 29/00*** | (2006.01) |
| ***B65H 29/10*** | (2006.01) |
| *B26D 7/00* | (2006.01) |

(52) U.S. Cl.

CPC ..... *B26D 1/045* (2013.01); *B26D 1/095* (2013.01); *B65H 29/003* (2013.01); *B65H 29/10* (2013.01); *B65H 35/06* (2013.01); *B26D 2007/0043* (2013.01); *B65H 2301/321* (2013.01); *B65H 2403/55* (2013.01); *B65H 2405/52* (2013.01); *B65H 2405/572* (2013.01); *B65H 2555/10* (2013.01); *Y10T 83/0448* (2015.04); *Y10T 83/2092* (2015.04)

(58) Field of Classification Search

CPC ..... B26D 1/045; B26D 1/095; B26D 1/56; B26D 1/565; B26D 1/60; B26D 1/605; B65H 29/003; B65H 29/10; B65H 35/06; B65H 45/28; Y10T 83/4757; Y10T 83/476; Y10T 83/4763; B23D 25/00–25/10; B23D 36/0058; B41F 13/56; B41F 13/62

USPC ..... 83/318, 319, 320, 287, 288, 294, 350, 83/356.1, 357, 109–112

See application file for complete search history.

(56) References Cited

U.S. PATENT DOCUMENTS

| | | | |
|---|---|---|---|
| 6,454,692 | B2 | 9/2002 | Ganneval et al. |
| 2012/0111163 | A1 | 5/2012 | Baumuller et al. |

FOREIGN PATENT DOCUMENTS

| | | | |
|---|---|---|---|
| CN | 1319068 | A | 10/2001 |
| JP | S6481730 | A | 3/1989 |
| JP | H0228460 | A | 1/1990 |
| WO | 2010/142691 | A2 | 12/2010 |

*Primary Examiner* — Laura M Lee

(74) *Attorney, Agent, or Firm* — Laurence A. Greenberg; Werner H. Stemer; Ralph E. Locher

(57) ABSTRACT

A method and an apparatus for processing a web of a flexible material, in particular paper, moved along a direction of motion of the material, in which individual sections are produced from the material web by a first double-carriage linear motor and a second double-carriage linear motor, which are arranged parallel to the direction of motion of the material and each have a first carriage and a second carriage in the direction of motion of the material. Each of the carriages has a driving element.

4 Claims, 3 Drawing Sheets

FIG. 1A
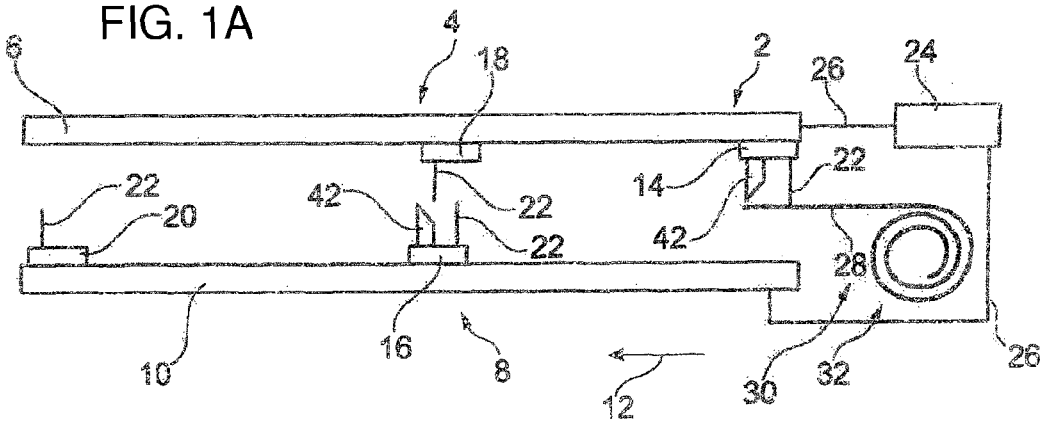
FIG. 1B
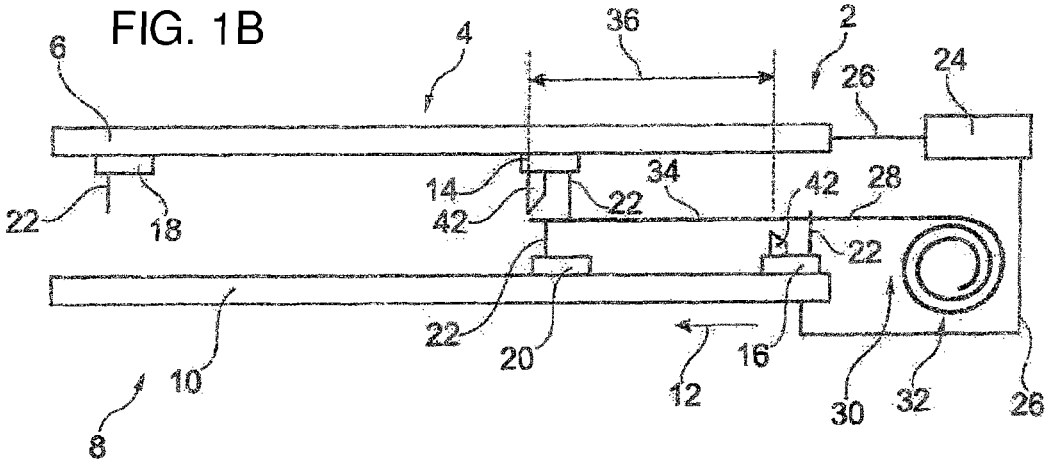
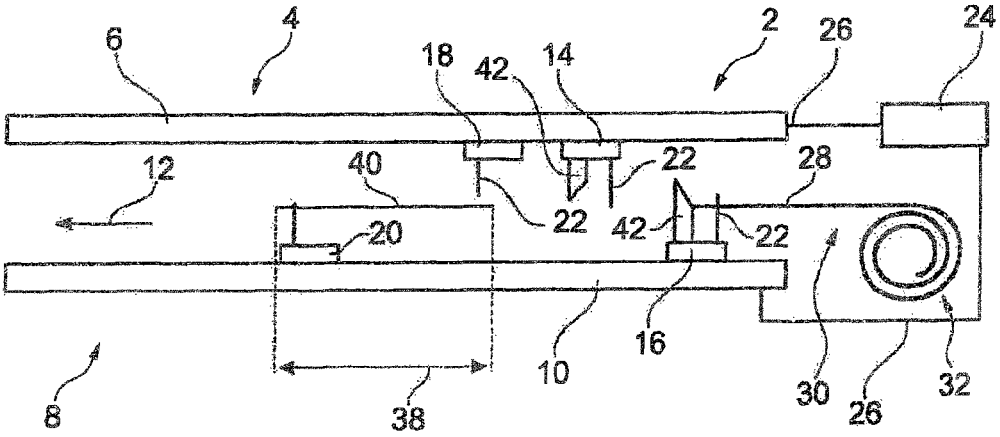
FIG. 1C

METHOD AND APPARATUS FOR PROCESSING A MATERIAL WEB

CROSS-REFERENCE TO RELATED APPLICATION

This application claims the priority, under 35 U.S.C. §119, of German application DE 10 2011 110 038.9, filed Aug. 12, 2011; the prior application is herewith incorporated by reference in its entirety.

BACKGROUND OF THE INVENTION

Field of the Invention

The invention relates to a method and an apparatus for processing a material web, in particular for producing individual sections from a web of a flexible material, for example of paper, moved along a direction of motion of the material. Here, processing is also understood to mean, for example, the folding of the sections produced by cutting the material web to length.

During newspaper printing, use is made of paper webs which are wound onto paper rolls. These paper rolls are unrolled or unspooled and the web is led through a printing press with the aid of a large number of rollers. In the printing press, ink is applied to the paper web, normally by the offset printing processes. By what is known as a jaw folder, the paper web is cut and thus individual sections forming the newspaper pages are created. With the aid of perforating needles of a folding blade cylinder of the jaw folder, the front end of the paper web is gripped and, by a rotational movement of the folding blade cylinder, the paper is at least partly transported along the circumference of the latter. A cutting blade cylinder arranged parallel to the folding blade cylinder is in contact with the paper and rotates in the direction opposite to the rotational movement of the folding blade cylinder.

At specific points along the circumference of the cutting blade cylinder, cutting knives are fitted to the latter, running along the axis of rotation. When these knives meet the paper web, the latter is severed there. If suitable, there are what are known as cutting bars on the folding blade cylinder at points corresponding to the cutting knives of the cutting blade cylinder. These cutting bars are used both to ensure the most exact cut possible and also to take care of the cutting knives and/or the folding blade cylinder itself. The aforementioned perforating needles are located comparatively closely after each of the cutting bars. In this way, the paper web and the sections created are pulled comparatively safely through the jaw folder without being kinked. The disadvantage with the jaw folder is that the size of the sections created is always the same and is predefined by the distribution of the cutting knives and cutting bars on the respective cylinders. If sections of another size are to be produced, then these two cylinders have to be replaced.

In international patent disclosure WO 2010/142691 A2, corresponding to U.S. patent publication No. 2012/0111163 A1, an apparatus is disclosed for producing individual, correct-format material sections from a web. An essential feature in this case is what are known as cross-tables with perforating needles, by which material web and the sections are transported along a direction of motion. An assembly of two linear motors as servo drives is designated a cross-table, the respective directions of movement thereof being orthogonal to each other. By one of the cross-tables, a region of the web is pulled along a direction of motion of the material and is separated by a cutting knife, which interacts with a cutting bar. The latter is fitted to a further one of the cross-tables.

The length of the sections created can be varied as desired, since the two-dimensional mobility of the two linear motors of each of the cross-tables permits the latter to be moved along a multiplicity of trajectories while avoiding collisions between the linear motors. Via a pair of rollers mounted downstream of the cross-tables, the section is transported to a folding blade. The latter introduces a fold into the sections at a predefined point, a gripper gripping the sections. After the gripper has been opened, the folded sections fall onto a sheet deliverer, which transports the sections away.

SUMMARY OF THE INVENTION

The invention is based on the object of specifying a method and an improved apparatus for processing a material web of a flexible material moved in a direction of motion of the material. Here, processing is understood to mean in particular the production of individual sections from the material web.

The method is used in the processing context for producing individual sections from a material web, which is moved along a direction of motion of the material and consists of a flexible material. The material is in particular paper, cord, fabric, film or the like also being conceivable. The method is used in particular during the production of newspapers or other printed products.

In order to carry out the method, a first and a second double-carriage linear motor are arranged parallel to the direction of motion of the material. A double-carriage linear motor is understood to mean an electric drive machine as a servo drive having a stator extending along a direction of motion, the direction of motion being linear. At least two rotors assigned to the drive machine interact with the stator and, during operation of the double-carriage linear motor, execute a translation along the direction of motion. In other words, a double-carriage linear motor is a conventional linear motor but which has two rotors. The rotors can be moved independently of each other, it being possible both for their position in relation to each other and their respective position relative to the stator to be varied. However, the order in which the rotors are located relative to the stator along the direction of motion is constant.

Each double-carriage linear motor has a first carriage in the direction of motion of the material and a second carriage, each of which comprises a driving element. In a first step, by the driving element of the first carriage of the first double-carriage linear motor, a region of the web that corresponds to the length of the section is pulled along the direction of motion of the material. In particular, the driving element of the first carriage grips the web in the front part or region of the section in the direction of motion of the material.

In a following step, the region is transferred to the driving element of the second carriage of the second double-carriage linear motor. For this purpose, the driving element of the second carriage grips the web in the front region or part of the section. During the transfer, these two carriages are expediently moved in the direction of motion of the material at the speed at which the web is also moved. During the transfer, the two driving elements remain suitably in contact with the web, so that no uncontrolled movements of the web are produced.

In a further step, which can be carried out after the region has been pulled by the first carriage of the first double-carriage linear motor but before, at the same time as or after the transfer, the web is gripped by the driving element of the first carriage of the second double-carriage linear motor. In the direction of motion, the gripping takes place in the front-most region of the section.

In a step following the transfer, the region is separated from the web by a cutting tool, the separation of the web being carried out by the first carriage of the first or second double-carriage linear motor. The section of the flexible material produced in this way is transported away by the second carriage of the second or first double-carriage linear motor.

By using the driving element of the first carriage of the second double-carriage linear motor, which has gripped the web in one of the preceding steps, a further region of the material is pulled along the direction of motion of the material and the method is carried out again, the function of the two double-carriage linear motors being interchanged. In particular, the method is repeated until a desired number of sections has been created.

Here, the length of the further region and thus the length of the section newly to be created can differ from the length of the original region. In other words, by the method it is made possible to produce, directly one after another, sections from the web, the length of which varies from one another. In particular, if the material is paper and the method is used within a production process of a newspaper, the sections created are processed further, for example folded and/or sorted.

The cutting tool is expediently carried by the first carriage of the second double-carriage linear motor, and a further cutting tool is carried by the first carriage of the first double-carriage linear motor. By the cutting tool, the material is cut before the driving element of the first carriage in the direction of motion, and the region located before the driving element is separated from the web. Since the cutting tool is carried along by the carriage, which moves at the speed of the web, movement of the web at different speeds is thus permitted, in each case it being possible for a straight cut edge, i.e. running at right angles to the direction of motion of the material, to be created.

The apparatus is used in the processing context at least for separating individual sections from a web of a flexible material moved along a direction of motion of the material and is expediently used for producing newspapers within a print shop. A stator both of a first and of a second double-carriage linear motor is arranged parallel to the direction of motion of the material. Fitted to each of the two stators such that they can move are a first and a second carriage, each of the carriages contains a rotor. The rotor interacts with the stator in such a way that the carriage can be moved along the stator. For example, the stator has a number of permanent magnets and the rotor has a coil which, with the application of a suitable current, interacts with the magnets of the stator. However, it would also be conceivable for the rotor to be formed as a permanent magnet and for the stator to comprise a number of coils, or for both the rotor to have an electromagnet and for the stator to have a number of electromagnets.

Each carriage has a driving element, by which the material is transported along the direction of motion of the material. In particular, the sections are removed from the web by the driving elements of the second carriage and conveyed to a further machine, which processes the sections further, for example folds them. Here, the sections can be transferred, for example, to a further driving element or, particularly preferably, the sections are at least partly processed while the sections are in contact with those driving elements.

Advantageously, the respective first carriage has a cutting tool. By means of these cutting tools, the sections are separated from the web. In an expedient embodiment of the invention, each of the carriages has a pivoting motor, which is operatively connected to the respective driving element of the carriage. The pivoting motor is configured in particular as a 90° pivoting drive. By the pivoting motor, it is made possible to pivot the driving element on to the web.

Expediently, the driving elements have mutually parallel gripper bars arranged on both sides of the web. In particular, the gripper bars are pivoted by the pivoting motor out of a position parallel to the direction of motion of the material into a position perpendicular to the latter and, in addition are moved toward each other, for example by using the same drive or by a further drive. In this way, the material web is held securely between the gripper bars of each driving element and can thus be gripped and pulled. By using a movement opposite thereto, the driving elements are released from the web.

The rotor is advantageously formed as an electromagnet and thus has a coil. The rotor is advantageously non-ferrous and thus has the lowest possible mass. This makes it possible for the carriage to be accelerated and braked again comparatively quickly, so that the processing of comparatively many sections one after another can be carried out in a short time. Furthermore, the speed with which the web is moved can be increased as compared with an apparatus in which a rotor having an iron core and therefore with a high inertia is used.

The two double-carriage linear motors are expediently arranged on opposite sides of the web and in particular diametrically with respect to the web.

In an expedient embodiment of the invention, the apparatus has a control unit. The control unit is equipped by programming and/or circuitry to control the individual carriages of the two double-carriage linear motors. For this purpose, the control unit has a microprocessor, for example. The carriages and the driving elements thereof are synchronized with one another by the control unit in such a way that the above method is carried out by the apparatus. Furthermore, the carriages are coordinated with one another in such a way that they do not collide during operation.

Other features which are considered as characteristic for the invention are set forth in the appended claims.

Although the invention is illustrated and described herein as embodied in a method and an apparatus for processing a material web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 1A-1C are diagrammatic illustrations for describing a method for producing individual sections from a web by an apparatus according to the invention, having a first arrangement of two double-carriage linear motors;

DETAILED DESCRIPTION OF THE INVENTION

Figure 2:
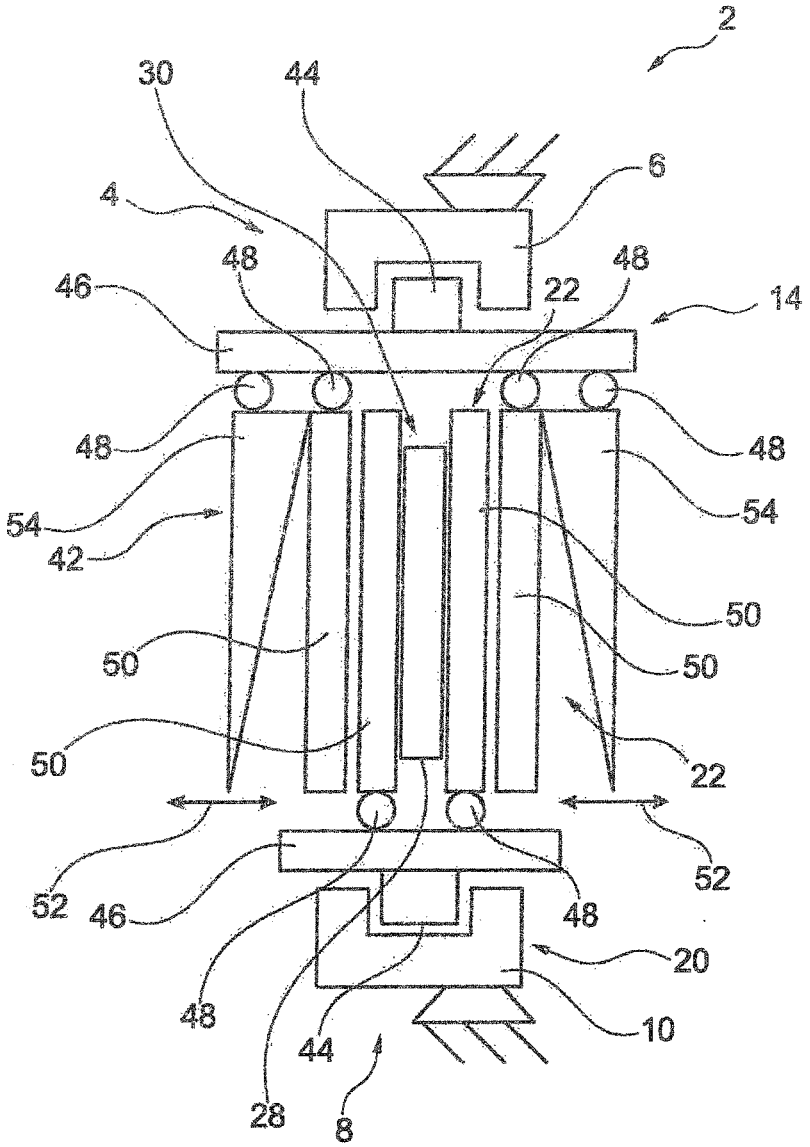
FIG. 2 is a diagrammatic, illustration of the apparatus for producing individual web sections, having a second arrangement of the two double-carriage linear motors.

In all the figures, mutually corresponding parts are provided with the same designations.

FIGS. 1A to 1C show schematically in a time sequence an apparatus 2 which contains a first double-carriage linear motor 4 having a stator 6, and a second double-carriage linear motor 8 having a stator 10, the two stators 6, 10 being arranged parallel to each other and to a rectilinear direction of motion 12 of a material.

The first double-carriage linear motor 4 and the second double-carriage linear motor 8 have a first carriage 14 and 16, respectively, in the direction of motion 12 of the material and a second carriage 18 and 20, respectively, which can each be moved relative to the associated stator 6 and 10. Each of the carriages 14, 16, 18, 20 has a driving element 22. The carriages 14, 16, 18, 20 are controlled by a control unit 24, which is connected to the two double-carriage linear motors 4, 8 via supply/data lines 26.

The two double-carriage linear motors 4, 8 are arranged diametrically with respect to a web 28, which consists of a flexible material 30 and which is moved along the direction of motion 12 of the material between the two double-carriage linear motors 4, 8. For this purpose, the web 28 is set moving, for example by rollers not illustrated, and unwound from a material roll 32. The material 30 is paper and the apparatus 2 is a constituent part of what is known as a web-fed offset printing press, by which newspapers are produced. For example, between the roll 32 and the apparatus 2 there are machines by which ink is applied to the web 28.

In a first step, the driving element 22 of the first carriage 14 of the first double-carriage linear motor 4 grips the web 28. The contact between the driving element 22 and the web 28 here is located substantially at the front edge of the web 28 in the direction of motion 12 of the material (FIG. 1A). By using the driving element 22, a region 34 of the web 28 is pulled in the direction of motion 12 of the material. The region 34 has a length 36 which is exactly the same size as a length 38 of a section 40 to be created by the apparatus 2.

The region 34 is transferred to the driving element 22 of the second carriage 20 of the second double-carriage linear motor 8. For this purpose, the second carriage 20 is moved into a position which corresponds substantially to a mirror-image of the position of the first carriage 14 of the first double-carriage linear motor 4. As soon as this position has been reached, the second carriage 20 is moved at the speed of the first carriage 14 in the direction of motion of the latter, which corresponds to the direction of motion 12 of the material. While the second carriage 20 is consequently moved onward substantially parallel to the first carriage 14, the web 28 is transferred to the latter. The driving element 22 of the second carriage 20 grips the web 28 in the vicinity of that point at which the web 28 has been pulled by the driving element 22 of the first carriage 14. After the driving element 22 of the second carriage 20 has gripped the web 28, the driving element 22 of the first carriage 14 is detached from the web and the web 28 is also pulled further in the direction of motion 12 of the material by the driving element 22 of the second carriage 20. In this way, undesired loading of the web 28 is avoided, which, for example, could lead to creasing of the web 28 or tearing of the same.

Following the transfer of the web 28 to the second carriage 20 of the second double-carriage linear motor 8, the driving element 22 of the first carriage 16 of the second double-carriage linear motor 8 grips the web 28. Here, the web 28 is gripped substantially at a distance from the leading edge of the web 28 which corresponds to the distance of the gripping point of the first carriage 14 of the first double-carriage linear motor 4 from the leading edge plus the length 36 of the region 34. In other words, the first carriage 16 of the second double-carriage linear motor 8 grips the web at a distance behind the first carriage 16 of the first double-carriage linear motor 4 that amounts to the length 36 of the region 34.

At least after gripping the web 28, the first carriage 16 is moved at the speed of the second carriage 20 of the second double-carriage linear motor 8, so that the distance between the first carriage 16 and the second carriage 20 of the second double-carriage linear motor 8 remains constant in each case and corresponds approximately to the length 36 of the region 34. However, the action of gripping the web 28 by the first carriage 16 of the second double-carriage linear motor 8 could also be carried out chronologically before the transfer of the web from the first carriage 14 of the first double-carriage linear motor 4 to the second carriage 20 of the second double-carriage linear motor 8 or at the same time as the transfer (FIG. 1 B).

After the web 28 has been gripped by the driving element 22 of the first carriage 16 of the second double-carriage linear motor 8, the region 34 is separated from the web 28 by a cutting tool 42 of the first carriage 16 and, in this way, the section 40 is created. Here, the separation is carried out at a point the distance of which from the leading edge of the web 28 corresponds to the length 36 of the region 34. Following the separation, the section 40 is transported away by the second carriage 20 of the second double-carriage linear motor 8. For this purpose, the second carriage 20 is accelerated, so that the speed thereof is greater than the speed with which the web 28 is moved onward. The distance between the first carriage 16 and the second carriage 20 is thus enlarged. The section 40 is processed further in a conventional manner, for example folded and sorted (FIG. 1C).

The first carriage 16 of the second double-carriage linear motor 8 is moved further in the direction of motion 12 of the material at the speed of the web 28, and thus a further region 34 is pulled along the direction of motion 12 of the material. The web 28 is transferred to the second carriage 18 of the first double-carriage linear motor 4, and the further region 34 is separated from the web 28 and transported away after the first carriage 14 of the first double-carriage linear motor 4 has gripped the web behind the region 34. The length 38 of two sections 40 created chronologically one after the other can vary here. For example, the length 38 of a second section 40 created directly following the creation of a first section 40 is half as great as that of the first section 40. It is merely necessary to take care that the length 36 of the regions 34 coincides with the length 38 of the sections 40. The method is repeated until the desired number of sections 40 has been separated from the web 28. During the production of the sections 40, the speed of the web 28 is expediently constant and is, for example, between 20 m/s and 30 m/s.

The sections 40 separated from the web 28 are transported away in a manner not specifically illustrated here and, for example, according to international patent application WO 2010/142691 A2, mentioned at the outset, as described in paragraphs [0039] up to [0041] inclusive and in paragraph [0044], are processed by a folding and depositing device. Instead of the known pair of rollers, linear drives can likewise be used to transport the sections 40 to the folding and depositing device and thus to further processing, in particular in continuation of the double-carriage linear drives 4, 8.

FIG. 2 shows a sectional illustration of the apparatus 2 in a view in which the arrangement of the double-carriage linear motors 4 and 8 have been rotated through 90° with respect to the arrangement according to FIGS. 1A to 1C and is oriented at right angles to the direction of motion 12 of the material. The first double-carriage linear motor 4 and the second double-carriage linear motor 8 are located on opposite sides of the web 28 of flexible material 30. A rotor 44 of the first carriage 14 engages in the U-shaped stator 6 of the first double-carriage linear motor 4. The rotor 44 contains a preferably non-ferrous coil which, when a suitable current is applied, interacts with permanent magnets possessed by the stator 6. Located on the rotor 44 is a platform 46, on which a number of pivoting motors 48, four pivoting motors 48 in the FIG. 2, is fitted. The pivoting motor 48 is what is known as a 90° pivoting drive.

By two of the pivoting motors 48, gripper bars 50 of the driving element 22 are pivoted about an axis of rotation which runs normally with respect to the material web 28, and are moved transversely along a working direction 52. The driving element 22 of the first carriage 14 contains two gripper bars 50, which are arranged on opposite sides of the web 28 and the length of which is greater than the width of the web 28, so that the gripper bars 50 reach substantially over the latter. If the gripper bars 50 are moved toward each other in the working direction and toward the web 28, it is possible to fix the latter by the gripper bars 50 and thus to pull the web along the direction of motion 12 of the material. During a movement running in the opposite direction, the web 28 can be released again.

The cutting tool 42 is attached to the two further pivoting motors 48. The cutting tool 42 contains two blades 54 which, in a way comparable with the gripper bars 50, are pivoted and moved by the pivoting motors 48. By a movement of the blades 54 toward each other along the working direction 52, it is made possible to sever the web 28.

The second carriage 20 of the second double-carriage linear motor 8 is constructed in substantially the same way as the first carriage 14 of the first double-carriage linear motor 6 but the second carriage 20 has only two pivoting motors 48, to which two gripper bars 50 are operatively connected. The gripper bars 50 of the second carriage 20 are in contact with the web 28, whereas the gripper bars 50 of the first carriage 14 are moved away from the web by the pivoting motors 48 of the carriage. Furthermore, the second carriage 20 has no cutting tool 42, for which reason the platform 46 thereof can be dimensioned to be smaller.

The first carriage 16 of the second double-carriage linear motor 8 and the second carriage 18 of the first double-carriage linear motor 4 are constructed in the same way as the first carriage 14 of the first double-carriage linear motor 4 and the second carriage 20 of the second double-carriage linear motor 8.

Figure 3A:
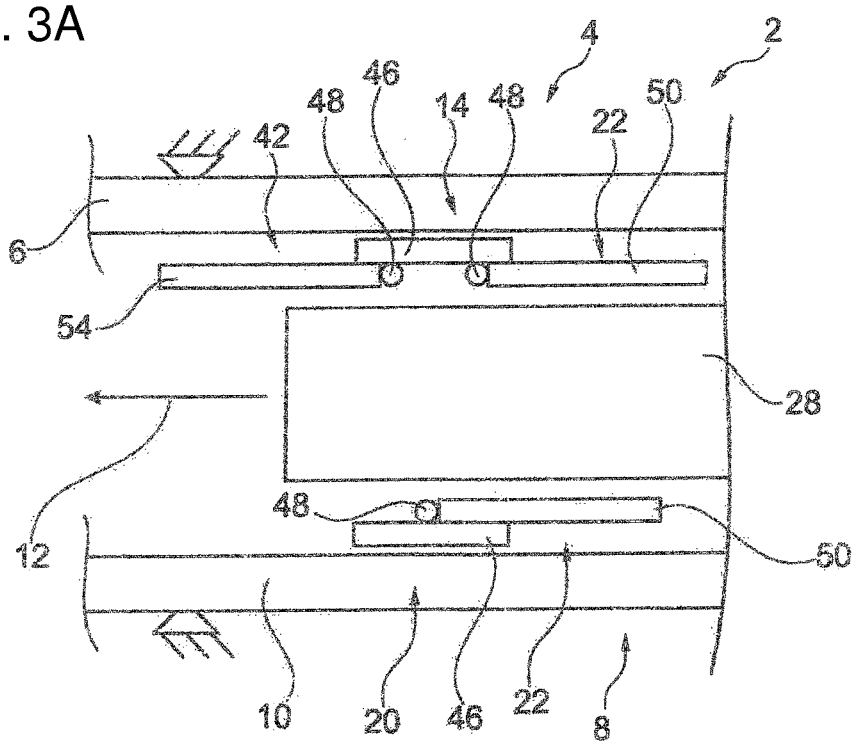
FIGS. 3A-3B are diagrammatic side-views of the apparatus.
Figure 3B:
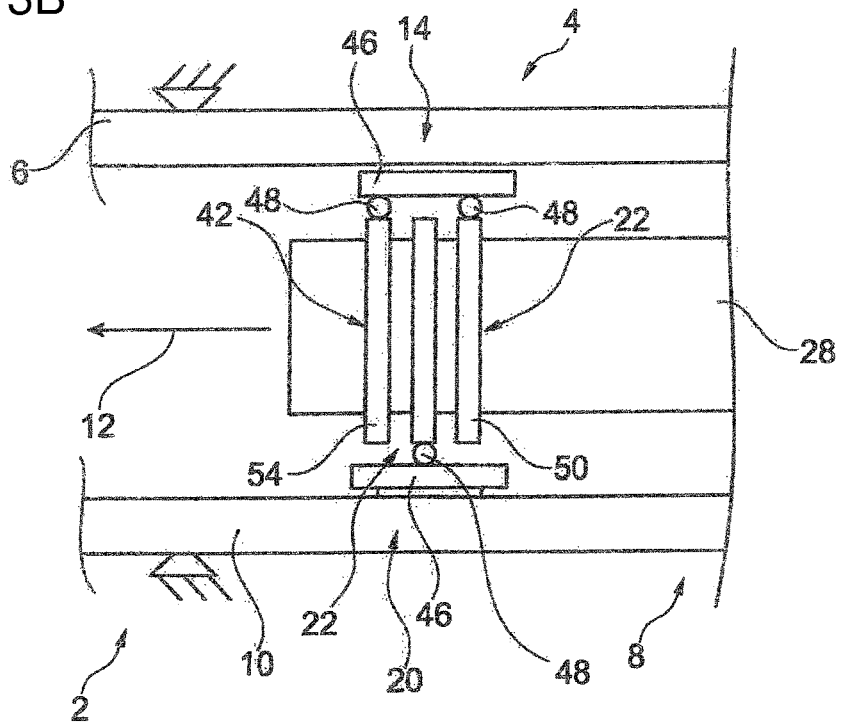

In FIGS. 3A and 3B, a detail of the apparatus 2 is shown schematically in a side view. In each of FIGS. 3A and 3B, the first carriage 14 of the first double-carriage linear motor 4 and the second carriage 20 of the second double-carriage linear motor 8 are shown, in FIG. 3B the driving elements 22 of the carriages 14, 20 and the cutting tool 42 of the first carriage having been moved by the pivoting motors 48 into a position which runs at right angles to the direction of motion 12 of the material. On the other hand, in FIG. 3A the driving elements 22 and the cutting tool 42 are in each case arranged substantially parallel to the direction of motion 12 of the material. The gripper bars 50 are pivoted by the pivoting motors 48 counter to the direction of motion 12 of the material, the blades 54 in the direction of motion 12 of the material.

The invention thus relates to a method and an apparatus 2 for processing a web 28 of a flexible material 30 that is moved along a direction of motion 12 of the material, in which individual sections 40 are produced from the material web 28 by a first double-carriage linear motor 4 and a second double-carriage linear motor 8, which are arranged parallel to the direction of motion 12 of the material, and which each have a first carriage 14, 16 and a second carriage 18, 20 in the direction of motion 12 of the material, each carriage having a driving element 22.

Expediently, both the movements, i.e. the positions, the speeds and the accelerations, of the carriages 14, 16, 18, 20 and also those of the driving elements 22 and also the cutting and gripping tools 50, 54 and the pivoting motors 48 are controlled by the control unit 24 and, if appropriate or necessary, synchronized with one another.

The invention is not restricted to the exemplary embodiments described above. Instead, other variants of the invention can also be derived therefrom by those skilled in the art without departing from the subject matter of the invention. In particular, all individual features described in connection with the various exemplary embodiments can moreover also be combined with one another in another way without departing from the subject matter of the invention.

The invention claimed is:

1. An apparatus for processing a web of a flexible material moved along a direction of motion of the flexible material, the apparatus comprising:

a first double-carriage linear motor disposed parallel to the direction of motion of the flexible material and having a first carriage in the direction of motion of the flexible material for separating individual sections from the web, and a second carriage for transporting the flexible material along the direction of motion of the flexible material, said first carriage of said first double-carriage linear motor having a cutting tool for separating the individual sections from the web;

a second double-carriage linear motor disposed parallel to the direction of motion of the flexible material and having a first carriage in the direction of motion of the flexible material for separating individual sections from the web, and a second carriage for transporting the flexible material along the direction of motion of the flexible material;

said second carriage of each of said first and second double-carriage linear motors having a driving element for transporting the flexible material along the direction of motion of the flexible material; and a control unit programmed to:

pull a region of the web corresponding to a length of one of the individual sections along the direction of motion of the flexible material by means of said driving element of said first carriage of said first double-carriage linear motor;

transfer the region to said driving element of said second carriage of said second double-carriage linear motor;

chronologically before a separation of the region from the web, grip the web after the region in the direction of motion by means of said driving element of said first carriage of said second double-carriage linear motor;

separate the region from the web by means of said cutting tool resulting in a separated region; and transport away the separated region by means of said driving element of said second carriage of said second double-carriage linear motor.

2. The apparatus according to claim 1, further comprising motors, each of said first and second carriages being assigned one of said motors for pivoting said driving element onto the web.

3. The apparatus according to claim 1, wherein each of said first and second carriages of said first and second double-carriage linear motors has a non-ferrous rotor.

4. The apparatus according to claim 1, wherein said first and second double-carriage linear motors are disposed diametrically with respect to the web.

* * * * *